US005199590A

United States Patent [19]

Grandahl et al.

[11] Patent Number: 5,199,590

[45] Date of Patent: Apr. 6, 1993

[54] COLLAPSIBLE DEVICE FOR SECURING A COVER OVER A SWIMMING POOL

[76] Inventors: Lance Grandahl, One Grandview Ter., E. Windsor, Conn. 06088; Gary Jeanfaivre, 865 Clintonville Rd., Wallingford, Conn. 06492

[21] Appl. No.: 767,118

[22] Filed: Sep. 27, 1991

[51] Int. Cl.[5] ..... B65D 25/08

[52] U.S. Cl. ..... 220/222; 220/216; 220/666

[58] Field of Search ..... 220/666; 206/218, 216, 206/222

[56] References Cited

U.S. PATENT DOCUMENTS

| | | | |
|---|---|---|---|
| 3,083,877 | 4/1963 | Gash | 220/666 |
| 3,270,905 | 9/1966 | Kroekel | 220/666 |
| 3,324,917 | 6/1967 | Schirtzinger | 220/666 |
| 3,939,887 | 2/1976 | Scarnato | 208/218 |
| 3,939,888 | 2/1976 | Scarnato | 206/218 |
| 4,806,098 | 2/1989 | Ramm et al. | 220/666 |
| 4,875,576 | 10/1989 | Torgrimson et al. | 206/218 |
| 4,955,493 | 9/1990 | Touzani | 220/666 |

FOREIGN PATENT DOCUMENTS

| | | | |
|---|---|---|---|
| 406134 | 6/1989 | European Pat. Off. | 220/666 |

*Primary Examiner*—Joseph Man-Fu Moy
*Attorney, Agent, or Firm*—Melvin I. Stoltz

[57] ABSTRACT

A collapsible device for securing a cover over a swimming pool includes an elongated container body having a pair of substantially rigid foot portions, each having a flat bottom wall, connected by an axially collapsible bellows portion. The device may be either extended and filled with a liquid for use in weighting a pool cover, or emptied and collapsed for storage.

20 Claims, 2 Drawing Sheets

COLLAPSIBLE DEVICE FOR SECURING A COVER OVER A SWIMMING POOL

BACKGROUND OF THE INVENTION

In climates where the temperature drops below the freezing point of water during the winter months, in-ground swimming pools are typically protected with a "winter cover". A winter cover is a sheet of material, e.g. polyvinylchloride ("vinyl") or other polymer, that is placed over the pool area. A winter cover is typically held in place with water bags, i.e. elongated tubular vinyl bags having closed ends and equipped with a capped filler neck, which are filled with water, capped and placed on top of the winter cover along the periphery of the pool to hold the cover in place.

Conventional water bags have a short life span, are prone to puncture damage and are somewhat awkward to use.

SUMMARY OF THE INVENTION

A collapsible device for securing a cover over a swimming pool is disclosed. The container includes an elongated container body for containing a fluid and filler means for allowing transfer of fluid into or out of the container body. The container body includes first and second substantially rigid tubular foot portions, each having a closed end and an open end and including a flat bottom wall portion, and an axially collapsible tubular bellows portion extending axially between the open ends of the foot portions and integral with the foot portions. The device may be extended and filled with fluid for use as a weight for securing a pool cover on a swimming pool or emptied of fluid and collapsed for storage.

In a preferred embodiment, the bellows portion is self latching and releasably maintains the bellows in a collapsed position.

DETAILED DESCRIPTION OF THE INVENTION

Figure 4:
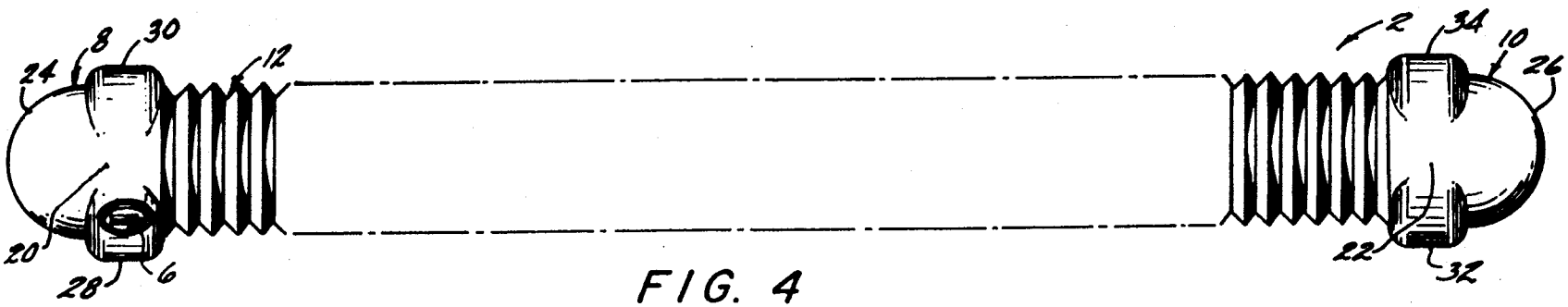
FIG. 4 shows a top view of the container of FIG. 1.
Figure 1:
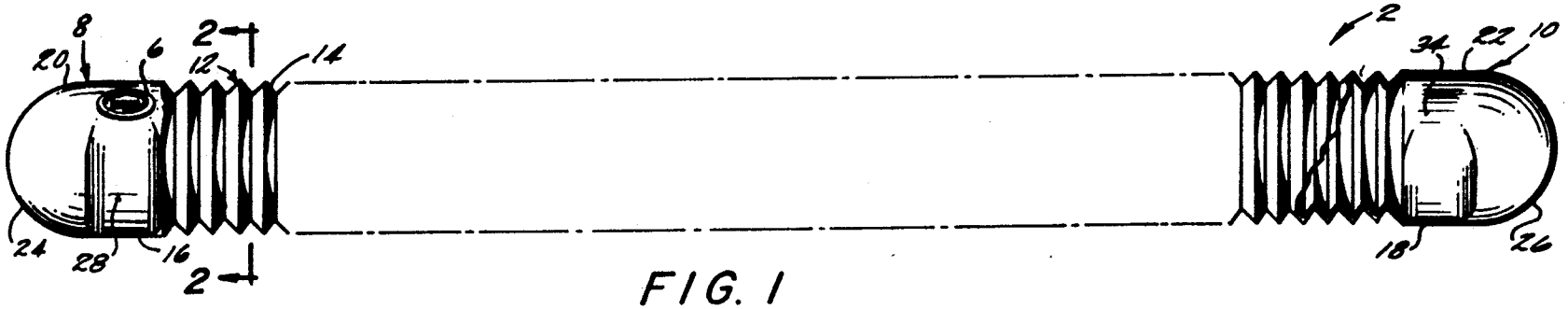
FIG. 1 shows a partially broken away side elevational view of the container of the present invention.
Figure 3:
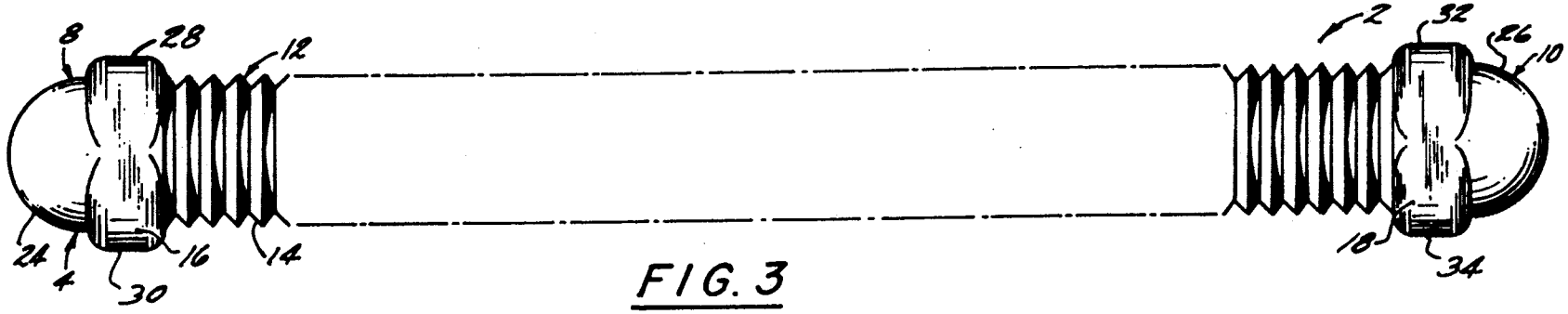
FIG. 3 shows a bottom view of the container of FIG. 1.
Figure 6:
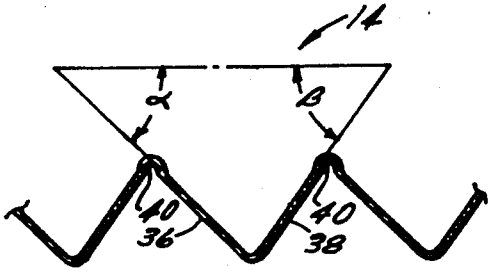
FIG. 6 shows a cross sectional view of a portion of a preferred embodiment of the bellows portion of the present invention.
Figure 5:
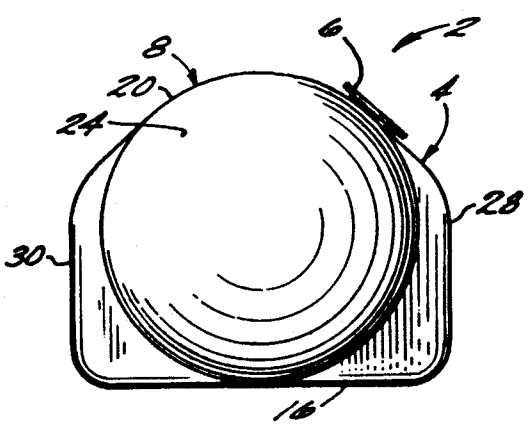
FIGS. 5 shows a left elevational end view of the container of FIG. 1.
Figure 2:
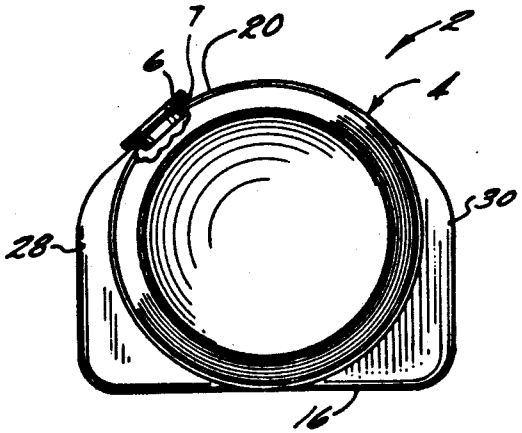
FIG. 2 shows a transverse partially broken away cross sectional view along line 2—2 of FIG. 1.

Referring to FIGS. 1-5, the device 2 of the present invention includes a container body 4 and a tapered filler plug 6 press fit within a filler orifice 7 defined in the container body 4. Alternatively, the simple orifice and tapered plug 6 may be replaced with a threaded filler neck and threaded cap for tightly sealing the filler orifice.

The container body 4 includes a pair of foot portions 8, 10 and a tubular portion 12 extending axially between and continuous with the end portions 8, 10. The tubular portion 12 includes bellows 14.

The foot portions 8, 10 include respective flat bottom wall portions 16, 18, curvilinear top wall portions 20, 22, hemispherical end wall portions 24, 26 and oppossed pairs of side wall portions 28, 30, 32, 34.

In the preferred embodiment shown, the filler orifice 7 is defined in the top wall portion 20 of foot portion 8 such that an angle of about 135° is defined between a line normal to the orifice and the flat bottom wall portion 16 of foot portion 8.

Referring to FIGS. 1, 3, 4 and 6, in a preferred embodiment, the bellows 14 includes a plurality of frustroconical portions 36, 38 joined by circular fold rings 40. The frustroconical portions 36, 38 include long conic portions 36 and short conic portions 38 alternately oriented along the longitudinal axis of the container. The long conic portions 36 diverge away from the longitudinal axis of the container at a first acute angle $\alpha$ and the short conic portions 38 converge toward the longitudinal axis of the container body 4 at a second acute angle $\beta$, wherein angle $\alpha$ is less than, i.e. more acute, than angle $\alpha$. Preferably, angle $\alpha$ is between about 25° and about 35° and angle $\beta$ is between about 35° and about 50°. Preferably, the conic portions 36, 38 and fold rings 40 form a self latching.

Alternatively, in a device having a threaded filler neck and threaded cap, the bellows portion 14 may be of a nonself-latching design, in which case the container is maintained in the collapsed position by reduced internal pressure generated by sealing the filler orifice, i.e. by tightly replacing the threaded cap on the threaded filler neck while the container is collapsed.

Figure 7:
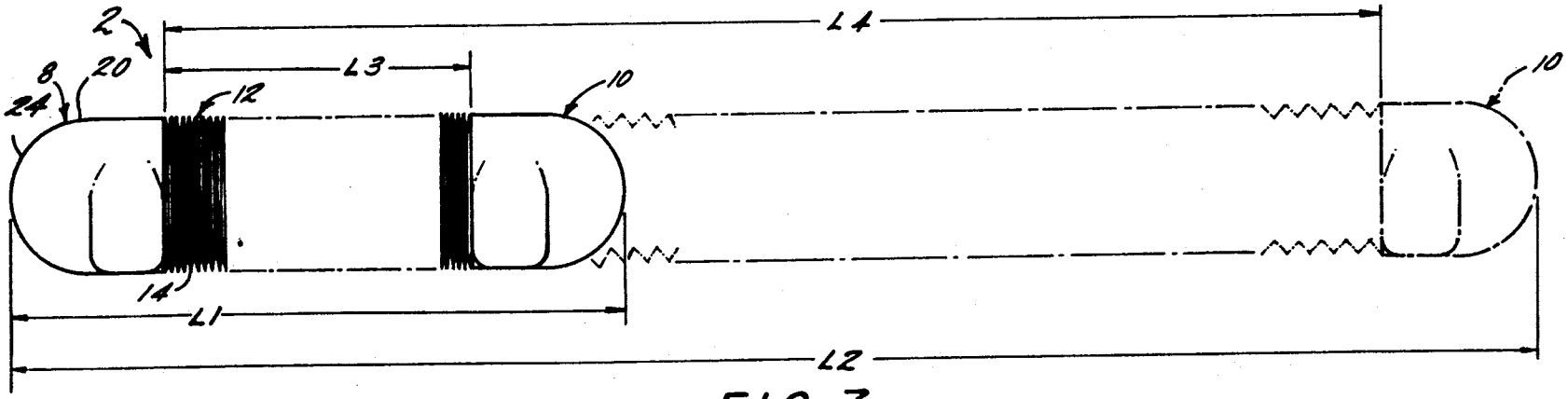
FIG. 7 shows a side elevational view of the container of the present invention in a collapsed position with an extended position shown in phantom lines.

Referring to FIG. 7, the device 2 has a collapsed position wherein the device extends axially from end wall 24 to end wall 26 for a first length L1 and an extended position wherein the device extends axially from end wall 24 to end wall 26 for a second length L2. Preferably, L2 is the product of L1 and a factor between about 2 and about 3.

The bellows portion 14 extends between end portions 20, 22 for a third length L3 in the collapsed position and for a fourth length L4 in the extended position. Preferably, L1 is the product of L3 and a factor between about 1.5 and about 2.0. Preferably, L2 is a product of L4 and a factor between about 1.1 and about 1.4. Preferably, L4 is a product of L3 and a factor between about 3 and about 5.

The device 2 may be constructed from any durable polymeric material, e.g. acrylonitrile or polyethylene by known blownmolding processes.

The device 2 may be extended and filled with liquid, e.g. water, for use as an elongated weight for securing a pool cover over a swimming pool and may be emptied and collapsed for storage. The flat bottom wall portions 16, 18, when placed on a flat surface of a substrate, prevent the device from rolling about its longitudinal axis. When the flat bottom wall Portions, 16, 18 of the foot portions 8, 10 are placed on a horizontal surface, the orientation of the filler orifice prevents the user from completely filling the device with water and leaves a vapor space above the water to allow expansion of water within the device under freezing conditions. This feature is beneficial in that bursting of the device due to expansion of water within the device under freezing conditions is precluded.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. A collapsible, easily stowable fluid container for securing a cover over a swimming pool, said container comprising A. an elongated, longitudinally extendible and easily collapsible central hollow portion construction for being easily moved between a first, compact, stowable position and a second, fully extended pool cover securing position;

B. first and second container stabilizing, end-forming portions formed from substantially rigid material, each of said end-forming portions comprising a. a substantially closed, hollow shape, b. an interior portal zone interconnected to and communicating with one end of the elongated, longitudinally extendible central hollow portion, whereby the hollow interior of the end-forming portions communicate with the hollow interior zone of the central portion, thereby forming a closed fluid holding container, and c. support means 1. formed on the outer surface of the end-forming portion, 2. positioned for contacting the cover of the swimming pool, and 3. providing, secure, rotation preventing retention of the end-forming portion and the elongated central hollow portion on the swimming pool cover; and C. filter means a. formed in at least one of said end-forming portions in a surface thereof generally opposed from the surface on which the support means is formed, and b. constructed for allowing the transfer of fluid into and out of the container;

whereby a collapsible, easily stowable fluid container is attained which is easily longitudinally extended and securely positioned on the cover of the swimming pool for being substantially filled with the desired fluid and retained in position for extended time periods, without any unwanted movement or dislodgement thereof.

2. The container defined in claim 1, wherein the elongated, longitudinally extendible hollow central portion comprises a bellows which may be axially collapsed or axially extended and the container has a first collapsed position, wherein the bellows is collapsed, and a second extended position, wherein the bellows is extended.

3. The device of claim 2, wherein the bellows is self-latching and releasably maintains the device in the collapsed position.

4. The device of claim 2, further comprising a cap for sealingly engaging with the filler means, wherein the device in a collapsed position is maintained in the collapsed position by engaging the cap and filler means to seal the collapsed container.

5. The device of claim 2, wherein the device extends axially from the closed end portion of the first end portion to the closed end portion of the second end portion for a first length when the device is in the collapsed position and for a second length when the device is in the extended position.

6. The device of claim 5, wherein the second length is the product the first length of a factor between about 2 and about 3.

7. The device of claim 4, wherein the bellows portion extends axially for a third length in the collapsed position and for a fourth length in the extended position.

8. The device of claim 7, wherein the first length is the product of the third length and a factor between about 1.5 and about 2.

9. The device of claim 7, wherein the second length is the product of the fourth length and a factor between about 1.1 and about 1.4.

10. The device of claim 7, wherein the fourth length is the product of the third length and a factor between about 3 and about 5.

11. The fluid container defined in claim 1, wherein the support means is further defined as comprising a substantially flat surface.

12. The fluid container defined in claim 11, wherein the closed of each of the end-forming portions is further defined as comprising a hemispherically shaped end wall.

13. The fluid container defined in claim 12, wherein the filler means comprises a filler orifice formed in one of said end-forming portions and further comprises means for closing said filler orifice.

14. The fluid container defined in claim 13, wherein the filler orifice is cylindrical in shape, and the means for closing said orifice comprises a tapered plug press fittably securable in said orifice.

15. The fluid container defined in claim 13, wherein the filler orifice is planar and an angle between about 120° and about 150° is defined by a line normal to the planar filler orifice and the flat bottom wall portion.

16. The fluid container defined in claim 11, wherein the bellows is further defined as being cylindrical in shape and the first and second end-forming portions are further defined as comprising substantially closed end cylindrical shapes, co-axially aligned with the bellows portion.

17. The fluid container defined in claim 11, wherein portions of the flat surface forming the support means of each end-forming portion is further defined as being substantially co-extensive with the outer surface of the end-forming portion.

18. The fluid container defined in claim 11, wherein the filler means is further defined as comprising a resealable orifice formed in the surface of the end-forming portion in juxtaposed, spaced, vertically aligned relationship with the flat surface.

19. A collapsible, easily stowable fluid container for securing a cover over a swimming pool, said container comprising A. an elongated, longitudinally extendible and easily collapsible central hollow portion comprising a bellows configuration and being easily moved between a first, compact, stowable position and a second, fully extended pool cover securing position;

B. first and second container stabilizing, end-forming portions formed from substantially rigid, closed end, tubular-shaped material, each of said end-forming portions comprising a. a substantially closed, hollow, cylindrical shape, b. an interior portal zone interconnected to and communicating with one end of the elongated, longitudinally extendible central hollow bellows portion, whereby the hollow interior of the end-forming portions communicate with the hollow interior zone of the central portion, and the central axis of the bellows is substantially coaxially aligned with the central axes of the end-forming portions, thereby forming a closed fluid holding container, and c. a substantially flat, outside wall zone
   1. formed on a portion of the outer surface of the end-forming portion,
   2. positioned for contacting the cover of the swimming pool, and
   3. providing, secure, rotation preventing retention of the end-forming portion and the elongated central hollow portion on the swimming pool cover; and C. filler means
   a. formed in at least one of said end-forming portions in a surface thereof generally opposed from the surface on which the support means is formed, and
   b. constructed for allowing the transfer of fluid into and out of the container;

whereby a collapsible, easily stowable fluid container is attained which is easily longitudinally extended and securely positioned on the cover of the swimming pool for being substantially filled with the desired fluid and retained in position for extended time periods, without any unwanted movement or dislodgement thereof.

20. The fluid container defined in claim 19, wherein the substantially flat outside wall zone of each end-forming portion are further defined as lying in a common plane, with said plane being parallel and non-intersecting relative to the central axis of the bellows portion and the end-forming portions.

* * * * *